US010125957B2

(12) United States Patent
Yuan

(10) Patent No.: US 10,125,957 B2
(45) Date of Patent: Nov. 13, 2018

(54) LIGHTING DEVICE AND MANUFACTURING METHOD

(71) Applicant: PHILIPS LIGHTING HOLDING B.V., Eindhoven (NL)

(72) Inventor: Mou Kun Yuan, Eindhoven (NL)

(73) Assignee: PHILIPS LIGHTING HOLLDING B.V., Eindhoven (NL)

( * ) Notice: Subject to any disclaimer, the term of this patent is extended or adjusted under 35 U.S.C. 154(b) by 125 days.

(21) Appl. No.: 14/917,911

(22) PCT Filed: Sep. 11, 2014

(86) PCT No.: PCT/EP2014/069386
§ 371 (c)(1),
(2) Date: Mar. 9, 2016

(87) PCT Pub. No.: WO2015/036478
PCT Pub. Date: Mar. 19, 2015

(65) Prior Publication Data

US 2016/0223143 A1 Aug. 4, 2016

(30) Foreign Application Priority Data

Sep. 12, 2013 (WO) ..... PCT/CN2013/001062
Nov. 22, 2013 (EP) ..... 13193980

(51) Int. Cl.
*F21V 7/20* (2006.01)
*F21V 17/10* (2006.01)
(Continued)

(52) U.S. Cl.
CPC ..... *F21V 17/10* (2013.01); *F21K 9/275* (2016.08); *F21K 9/66* (2016.08); *F21K 9/90* (2013.01);
(Continued)

(58) Field of Classification Search
CPC .... F21Y 2115/10; F21V 7/0008; H01L 33/60; F21S 4/20
See application file for complete search history.

(56) References Cited

U.S. PATENT DOCUMENTS

2011/0164417 A1 7/2011 Huang
2012/0120653 A1 5/2012 Peck et al.
(Continued)

FOREIGN PATENT DOCUMENTS

CN 101725920 7/2011
JP 2008287994 A 11/2008
(Continued)

*Primary Examiner* — Anh Mai
*Assistant Examiner* — Meghan Ulanday
(74) *Attorney, Agent, or Firm* — Akarsh P. Belagodu

(57) ABSTRACT

An environmentally responsible, optically efficient, low glare lighting device comprises: a tubular body (1); a first plurality of solid state light emitting elements (2) arranged on a first surface of a first carrier (3) inside said tubular body; and a flexible reflective sheet (4) covering said first surface and a first part of an inner surface of the tubular body (1) to an extent (6) sufficient to obscure direct visibility of the light emitting surface of the first light emitting elements (2) if viewed through a light outlet portion (5) from a location external to the tubular body (1), wherein said light outlet portion includes a second part of the inner surface that is not covered by the flexible reflective sheet. A convenient method for manufacturing the device is also described.

15 Claims, 5 Drawing Sheets

(51) Int. Cl.

| | |
|---|---|
| ***F21K 9/90*** | (2016.01) |
| ***F21V 7/00*** | (2006.01) |
| ***F21V 7/22*** | (2018.01) |
| ***F21V 29/89*** | (2015.01) |
| ***F21V 29/70*** | (2015.01) |
| ***F21V 7/16*** | (2006.01) |
| ***F21K 9/66*** | (2016.01) |
| ***F21K 9/275*** | (2016.01) |
| *F21V 29/00* | (2015.01) |
| *F21V 7/18* | (2006.01) |
| *F21K 9/60* | (2016.01) |
| *F21Y 103/10* | (2016.01) |
| *F21Y 115/10* | (2016.01) |

(52) U.S. Cl.
CPC ..... *F21V 7/005* (2013.01); *F21V 7/0008* (2013.01); *F21V 7/16* (2013.01); *F21V 7/22* (2013.01); *F21V 29/70* (2015.01); *F21V 29/89* (2015.01); *F21K 9/60* (2016.08); *F21V 7/18* (2013.01); *F21V 29/004* (2013.01); *F21Y 2103/10* (2016.08); *F21Y 2115/10* (2016.08)

(56) References Cited

U.S. PATENT DOCUMENTS

| | | | | |
|---|---|---|---|---|
| 2012/0201023 | A1 | 8/2012 | Yoneda | |
| 2013/0033888 | A1* | 2/2013 | Van Der Wel | F21V 3/06 362/555 |
| 2013/0050998 | A1 | 2/2013 | Chu et al. | |
| 2014/0340896 | A1* | 11/2014 | Verbeek | F21V 7/0008 362/235 |
| 2014/0355243 | A1* | 12/2014 | Yu | F21V 7/0008 362/84 |
| 2016/0138767 | A1* | 5/2016 | Luo | F21V 29/70 362/218 |

FOREIGN PATENT DOCUMENTS

| | | | |
|---|---|---|---|
| JP | 2012028095 | | 2/2012 |
| KR | 101212743 | B1 | 12/2012 |
| KR | 2013107114 | | 10/2013 |
| WO | WO2007088665 | A1 | 8/2007 |
| WO | WO2008136458 | A1 | 11/2008 |
| WO | WO2009157999 | A1 | 12/2009 |
| WO | 2012172697 | | 12/2012 |
| WO | 2013098700 | | 7/2013 |
| WO | 2013098723 | | 7/2013 |

* cited by examiner

LIGHTING DEVICE AND MANUFACTURING METHOD

CROSS-REFERENCE TO PRIOR APPLICATIONS

This application is the U.S. National Phase application under 35 U.S.C. § 371 of International Application No. PCT/EP2014/069386, filed on Sep. 11, 2014, which claims the benefit of European Application No. 13193980.3, filed Nov. 22, 2013, which claims the benefit of International Application No. PCT/CN2013/001062, filed Sep. 12, 2013. These applications are hereby incorporated by reference herein.

FIELD OF THE INVENTION

The present invention relates to tubular LED lamps (TLEDs) and in particular to s TLEDs which provide indirect illumination. A novel TLED lamp is described which provides reduced light intensity over a wide angle of illumination and retains good optical efficiency. A method of manufacture for the novel lamp is also described.

BACKGROUND OF THE INVENTION

Solid state lighting, e.g. lighting based on light emitting diodes (LEDs), is increasingly considered as the environmentally responsible replacement of more energy-inefficient traditional alternatives such as fluorescent and incandescent light sources.

TLEDs are well known, these lamps comprise of an array of solid state light emitting devices (typically LEDs) enclosed in a glass or plastic tube. It is known to use reflectors to reflect some or all of the light emitted by the light emitting devices and direct it to where illumination is most needed. Light emissions from LEDs are very intense and consequently glare can be a problem with LED lamps. A diffuser, typically in the form of a coating on the tube, disperses and mixes light from the LEDs or reflected by the reflector to achieve a more uniform luminescence. Whilst the issue of glare is addressed by the diffuser, some optical efficiency of the lamp is lost.

SUMMARY OF THE INVENTION

The invention provides a novel TLED and method of manufacture of the same as set out in the accompanying claims.

The lamp of the invention is environmentally responsible, optically efficient and glare from the light source is controlled without sacrifice to optical efficiency. The lamp can be manufactured in accordance with the methods of the invention in high volume and at low cost to the manufacturer.

An embodiment of a lighting device in accordance with the invention comprises:

a tubular body;

a first plurality of solid state light emitting elements arranged on a first surface of a first carrier inside said tubular body; and a flexible reflective sheet covering said first surface and a first part of an inner surface of the tubular body to an extent sufficient to obscure direct visibility of the light emitting surface of the first light emitting elements if viewed through a light outlet portion from a location external to the tubular body, wherein said light outlet portion includes a second part of the inner surface that is not covered by the flexible reflective sheet.

By arranging the reflective sheet to obscure direct visibility of the light emitting surfaces, the problem of glare from these surfaces is addressed. By positioning the reflector over the light emitting surfaces, a majority of the light emitted is reflected to and exits from the transparent light outlet portion so providing very good optical efficiency.

The flexible reflective sheet can be wrapped around the carrier. This simplifies assembly since the carrier can be used to anchor the reflective sheet in place.

The carrier can conveniently also serve as a heat sink. In one convenient arrangement, the heat sink comprises a length of sheet metal bent along an axis parallel to the longitudinal axis of the tubular body. Examples of suitable metal materials for the carrier include (without limitation) aluminium, copper and stainless steel. The flexible reflective sheet is wrapped around the angled metal sheet resulting in an enclosed elongate space of triangular cross section behind the light emitting devices. Examples of suitable materials for the flexible reflective sheet include (without limitation) resins embedded with reflective particles such as micro grade glass beads, or laminated with micro thin layers of reflective metals such as Aluminium. The resins might, for example comprise polyethylene terephthalate (PET) or polycarbonate (PC).

The flexible reflective sheet can be provided in the form of a reflective film. The specific make-up of the flexible reflective film is not crucial to the invention. Many flexible reflective films are known in the fields of lighting, solar panels and weather resistant mirrors. Without limitation, examples include multi-layered films comprising a flexible polymer base layer onto which silver is deposited and a durable and protective top layer, for example a fluorocarbon layer. The flexible reflective sheet is conveniently prior punched with holes to accommodate the positioning of light emitting devices on the carrier over which the flexible reflective sheet is to cover.

The first plurality of solid state light emitting elements can conveniently comprise an arrangement of light emitting diodes aligned in a strip, the strip extending along the length of the tubular body. The light emitting elements are carried by a flexible PCB secured to a surface of the first carrier. Since the lighting device of the invention is more optically efficient than prior art TLEDs, the quantity of light emitting elements needed to provide equivalent light output to prior art TLEDs is less. Hence, the lighting device of the invention can be configured to provide performance similar to prior art devices but at lower cost of components and manufacture and in a manner which is more energy efficient, thereby assisting the environment and reducing the user's energy bills.

In an option, an end cap can be provided to hold the assembled light emitting elements, carrier and reflector together.

A variant of the described embodiment can include a second plurality of solid state light emitting elements arranged on a second surface of a second carrier inside said tubular body; wherein the first surface and second surface are covered by opposing ends of the flexible reflective sheet. This configuration can be used to provide a brighter light, or alternatively simply to provide a device with a more symmetrical and hence aesthetically appealing appearance. For example, the first and second carriers are arranged in the tubular body on opposite sides of the light outlet portion.

Any of the described variants of the embodiment of the invention can be incorporated into a luminaire.

The described embodiments of the invention can be manufactured by; electrically connecting a first plurality of solid state light emitting elements to a first flexible printed circuit board;

providing a length of a first metal sheet bent along a longitudinal axis;

securing the first flexible printed circuit board to a first surface of the metal sheet;

forming an assembly by adhering a flexible reflective sheet to at least said first surface whilst leaving the first plurality of solid state light emitting elements exposed;

arranging the assembly in a tubular body such that the flexible reflective sheet covers a first part of an inner surface of said tubular body whilst leaving exposed a second part of said inner surface, said second part forming part of a light transmissive light outlet portion, and wherein the first part is dimensioned such that direct visibility of the light emitting surface of the light emitting elements is obscured if viewed through the light outlet portion from a location external to the elongate tubular body.

In a preferred method, the multiple light emitting elements comprise LEDs which are welded to the flexible PCB.

In the manufacture of a variant of the described embodiment, the method further involves electrically connecting a second plurality of solid state light emitting elements to a second flexible printed circuit board;

providing a length of a second metal sheet bent along a longitudinal axis;

securing the second flexible printed circuit board to a second surface of the metal sheet;

and adhering the flexible reflective sheet to at least said second surface whilst leaving the second plurality of solid state light emitting elements exposed, wherein said first surface and second surface are covered by opposite ends of the flexible reflective sheet.

Unhindered location and retention of the flexible reflective sheet in position in the tubular body can be achieved by providing a pair of oppositely magnetised metal strips for securing against a free end of the flexible reflective sheet, which strips are held in position over the free end of the flexible reflective sheet on opposing surfaces of the flexible reflective sheet, the first surface of the metal sheet being covered by an opposite end of the flexible reflective sheet prior to arranging the assembly in the elongate tubular body.

BRIEF DESCRIPTION OF THE DRAWINGS

The invention will now be described in more detail and with reference to the accompanying drawings in which.

DESCRIPTION OF PREFERRED EMBODIMENTS

Figure 1:
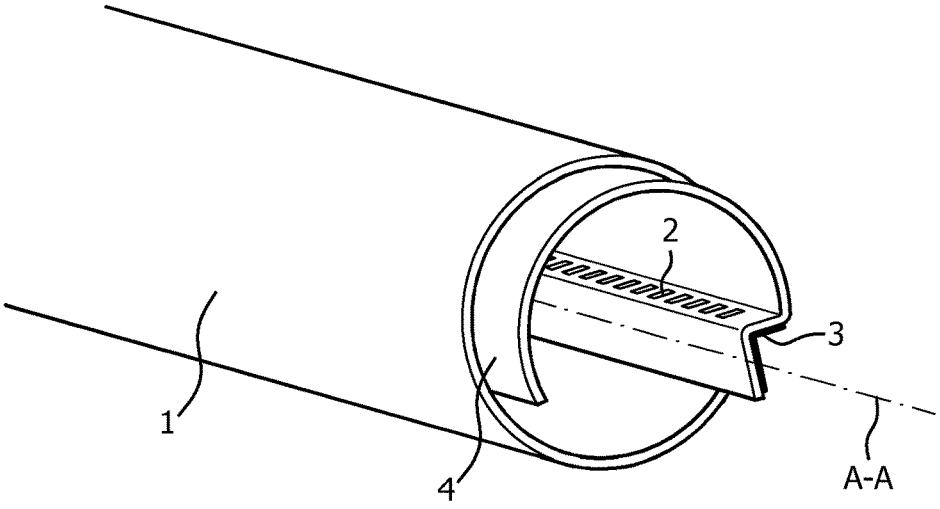
FIG. 1 is a schematic perspective view of a first embodiment of a lighting device in accordance with the invention.
Figure 2:
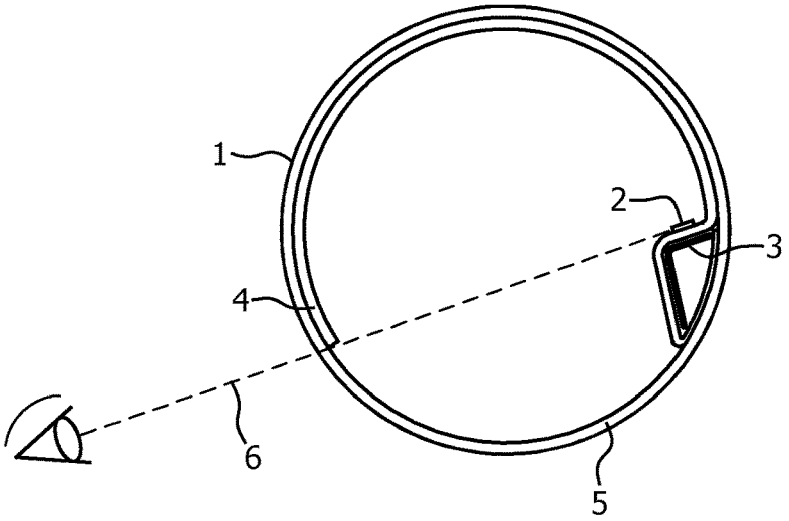
FIG. 2 is a schematic end view of the embodiment of FIG. 1.

A first embodiment of the lighting device is shown in FIGS. 1 and 2. The embodiment comprises of an at least partially transparent elongate tubular body 1 which contains the remainder of the assembly. As is known from the prior art, the elongate tubular body 1 can be made from glass or plastic. The internal components of the lighting device comprise a first carrier 3, in this case an elongate, angled strip of metal which serves also as a heat sink. Applied to a surface of the carrier is a plurality of solid state light (SSL) emitting elements 2. In an embodiment the SSL elements 2 are in the form of LEDs, for example organic or inorganic semiconductor LEDs and in the example shown are arranged in a strip array extending along the length of the tubular body 1. In this embodiment the LEDs are welded to a flexible printed circuit board (PCB) 7 (see also FIG. 5) which is adhered to the first surface of the first carrier 3. A high reflectivity film 4 serves as the flexible reflective sheet of the lighting device. The high reflectivity film is arranged to envelop the carrier 3. Where the high reflectivity film passes over the surfaces of the strip array of elements 2, holes are punched in the film to accommodate the elements but not cover them.

The flexible high reflectivity film 4 is rolled about an axis parallel with the longitudinal axis A-A of the tubular body 1 and is unfurled once inserted in the tubular body 1 and aligned against an inner curved surface of the tubular body 1 as is seen in FIG. 2. In an embodiment, the flexible high reflectivity film 4 can be elastically deformable from its preferred planar configuration and once released inside the tubular body 1 will unfurl itself until constrained by the inner curved surface of the tubular body 1.

As is seen in FIG. 2, the tubular body 1 includes a light outlet portion 5 which faces the aligned high reflectivity film 4. The dimensions of the high reflectivity film 4 are carefully selected so as to leave an unobstructed portion of the inner surface of tubular body 1 which defines the light outlet portion 5, whilst ensuring the direct line of sight 6 to the strip array of SSL emitting elements 2 is obscured by the high reflectivity film 4.

Figure 3:
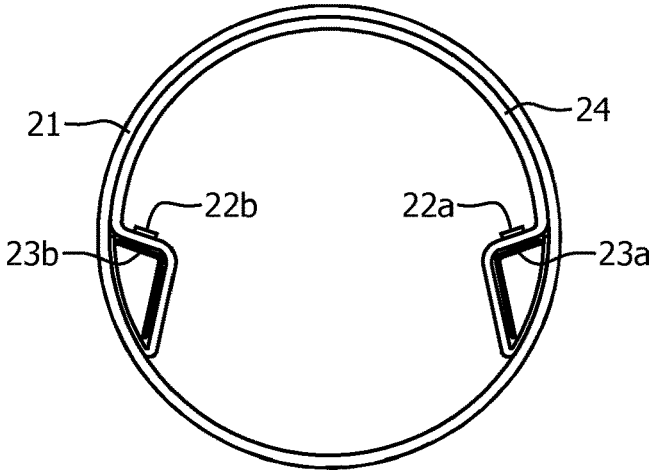
FIG. 3 is a schematic end view of a second embodiment of a lighting device in accordance with the invention.

A second embodiment of the invention is shown in FIG. 3. This arrangement includes a symmetrically arranged pairing of strip arrays of SSL emitting elements 22*a*, 22*b* and carriers 23*a*, 23*b* in the form of elongate, angled strips of metal which serve also as heat sinks. The pairing is arranged symmetrically inside a tubular body 21. In this embodiment a single high reflectivity film 24 envelopes both pairings

22*a,* 23*a* and 22*b,* 23*b,* an end of the high reflectivity film being wrapped around each carrier 23*a,* 23*b* to envelop the carrier 23*a,* 23*b.* Where the high reflectivity film 24 passes over the surfaces of the strip array of SSL emitting elements 22*a,* 22*b,* holes are again punched in the high reflectivity film to accommodate the SSL emitting elements 22*a,* 22*b* such that they protrude through the high reflectivity film 24 when the film covers the surface of the carriers 23*a,* 23*b.* Again, it is apparent from the Figure that the line of sight to each strip array 22*a,* 23*b* is obscured by the film 21.

Figure 4:
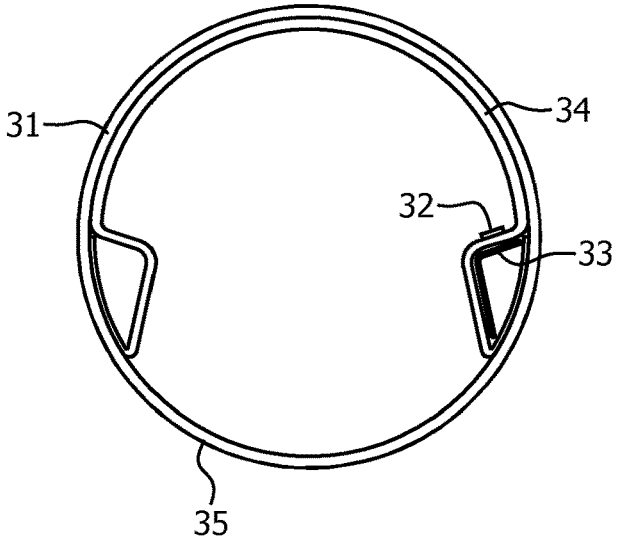
FIG. 4 is a schematic end view of a third embodiment of a lighting device in accordance with the invention.

A third embodiment of a lighting device in accordance with the invention is shown in FIG. 4. This embodiment is very similar to that of FIG. 3, however it includes just one strip array of SSL emitting elements 32 on carrier 33 inside a tubular body 31 which has a light outlet portion 35. In this case, a free end of high reflectivity film 34 is folded in a similar arrangement to another end which envelops the SSL emitting elements 32 and carrier 33 assembly to provide a more aesthetic, symmetrical appearance.

Figure 5:
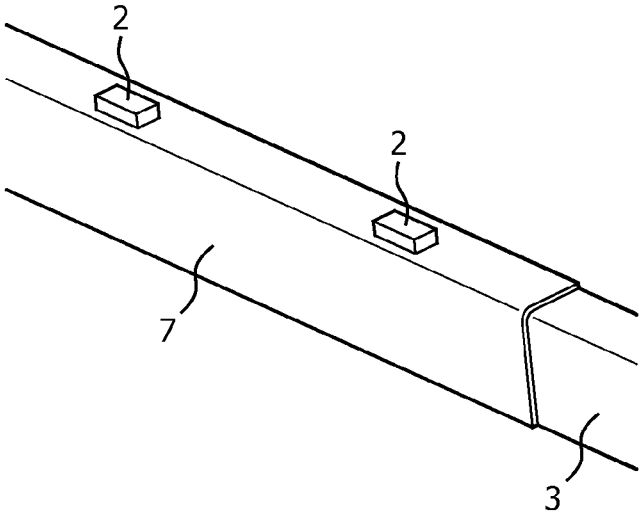
FIG. 5 shows schematically a more detailed view of a light emitting elements arrangement and carrier/heat sink assembly for use in multiple embodiments of the invention.

FIG. 5 shows in close up an assembled carrier 3 and strip array of SSL emitting elements, for example, LEDs 2, which would be suitable for incorporation in various embodiments of the invention including those already described. The carrier 3 is again provided in the form of an elongate, angled strip of metal which serves also as a heat sink. It can be seen from the figure that a flexible PCB film 7 has first been secured to the angled metal strip heat sink 3 (most probably, but not essentially, by means of an adhesive) and the LEDs welded to the flexible PCB film 7. It will be appreciated that care needs to be taken to avoid blocking the emission of light from the LEDs 2 when the highly reflective film 4 is wrapped around the assembly. As previously suggested, this could be achieved, for example, by punching spaces or holes in the highly reflective film for aligning of the LEDs 2, or by securing the LEDs through the reflector film to the PCB after the film has been wrapped around the carrier 3 and PCB 7 assembly.

Figure 6:
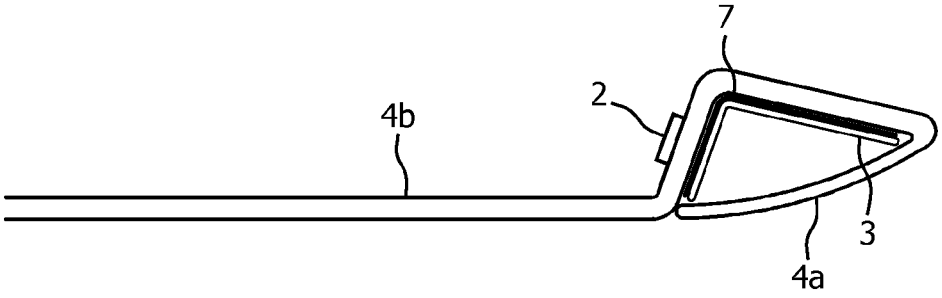
FIG. 6 shows schematically the assembly of a flexible high reflectivity sheet, light emitting elements arrangement and carrier/heat sink components in the manufacture of an embodiment of a lighting device in accordance with the invention.
Figure 7:
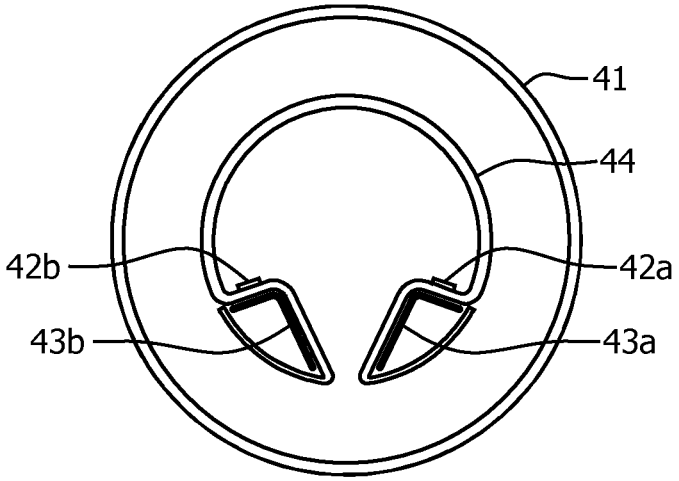
FIG. 7 shows schematically an assembled pair of light emitting elements arrangement and carrier/heat sink assemblies enveloped by a flexible high reflectivity sheet in position in an elongate tubular body during the manufacture of an embodiment of a lighting device in accordance with the invention.

FIG. 6 shows how, during manufacture, a high reflectivity film 4*a,* 4*b* is folded around a carrier 3 to which a flexible PCB film 7 has been secured. SSL emitting elements (LEDs 2) are welded to the PCB 7. The SSL emitting elements assist in securing the folded film 4*a,* 4*b* in place about the heat sink 3. FIG. 7 shows a fourth embodiment of the invention during the manufacturing process. The embodiment under manufacture is essentially the same as that of FIG. 3. As can be seen, the twin pairings of strip arrayed light emitting elements 42*a,* 42*b* and carriers 43*a,* 43*b* are enveloped by ends of the highly reflective film 44 prior to insertion into the tubular body 41. Resiliency in the highly reflective film 44 causes the assembly to expand within the tubular body 41 resulting in the arrangement shown in FIG. 3.

Figure 8:
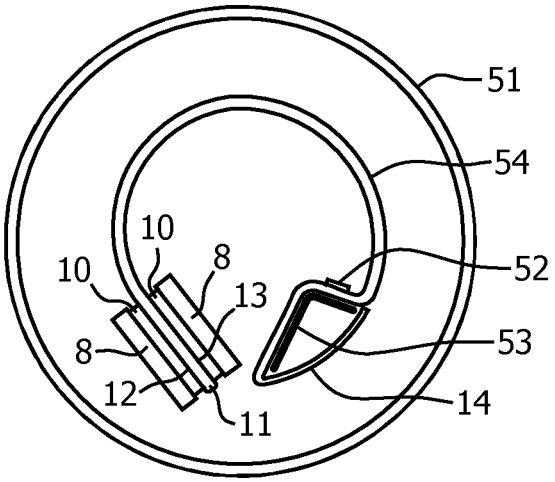
FIG. 8 shows schematically a single assembled light emitting elements arrangement and carrier/heat sink assembly enveloped by a flexible high reflectivity sheet in position in an elongate tubular body during the manufacture of another embodiment of a lighting device in accordance with the invention.

FIG. 8 shows a fifth embodiment of the invention. As in FIG. 7, the arrangement is shown at a point during the manufacture of a lighting device in accordance with an embodiment of the invention. Into tubular body 51 is inserted an assembly comprising carrier 53 carrying a strip array of SSL emitting elements, for example LEDs 52. A reflector 54 (for example, the already described high reflectivity film), is wrapped around the carrier 53 and secured by LEDs 52. The carrier is again provided in the form of an elongate, angled strip of metal which serves also as a heat sink. The free end of the reflector 54 is secured between oppositely magnetised metal strips 7 which are held in position over the free end by means of the attached, oppositely polarised magnets 8. Once the assembly is released inside the tubular body 51, the inner wall of the tubular body 51 further assists in holding the free ends of the reflector 54, and hence the entire assembly 7, 8, 52, 53, 54 in place inside the tubular body 51.

Figure 9:
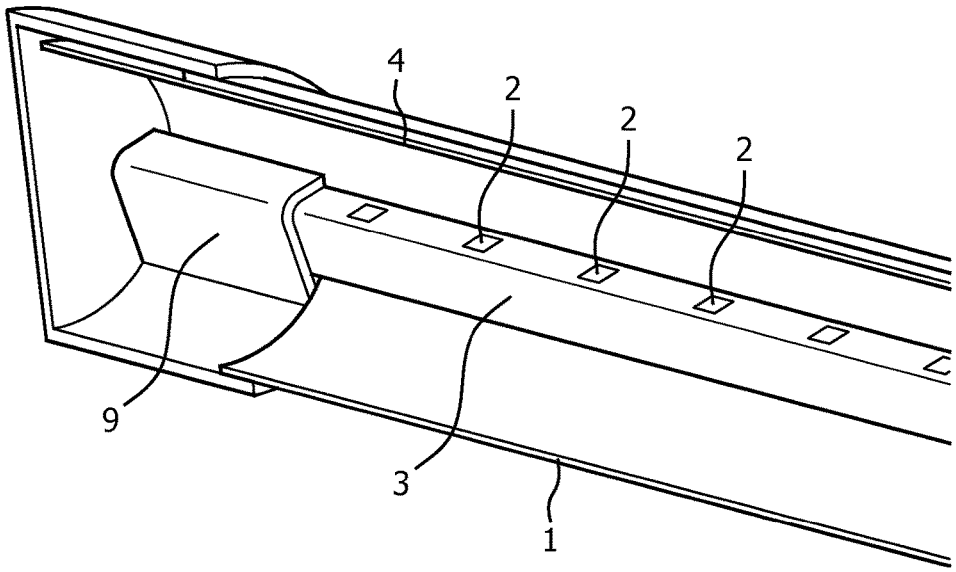
FIG. 9 shows in schematic form, a longitudinal cross section of an elongate tubular body enclosing light emitting elements, a reflector and a carrier/heat sink in accordance with an embodiment of the invention.

FIG. 9 shows how the carrier 3 of any of various embodiments, including those already described, might be used to secure a lighting device in accordance with embodiments of the invention in a housing. As can be seen from the Figure (which shows a longitudinal cross section through an assembled lighting device in accordance with the invention) a carrier 3 in the form of an elongate, angled strip of metal which serves also as a heat sink, is covered by a PCB film (not visible) to which is electrically connected a strip array of SSL emitting elements, for example LEDs 2. The carrier is enveloped by a high reflectivity film 4. The angled end of the carrier 3 is configured to fit into a moulded end cap 9 which may form part of a housing into which the lighting device is fitted for use.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a tubular body;

a first plurality of solid state light emitting elements arranged on a first surface of a first carrier inside said tubular body; and a flexible reflective sheet covering said first surface and a first part of an inner surface of the tubular body to an extent sufficient to obscure direct visibility of the light emitting surface of the first light emitting elements if viewed through a light outlet portion from a location external to the tubular body, wherein said light outlet portion includes a second part of the inner surface that is not covered by the flexible reflective sheet;

wherein the flexible reflective sheet is tubularly-shaped substantially similar to the tubular body such that the flexible reflective sheet is aligned against the inner surface of the tubular body.

2. A lighting device as claimed in claim 1 wherein the flexible reflective sheet is wrapped around the carrier.

3. A lighting device as claimed in claim 1 wherein the carrier comprises a heat sink.

4. A lighting device as claimed in claim 3 wherein the heat sink comprises a length of sheet metal bent along an axis parallel to the longitudinal axis of the tubular body.

5. A lighting device as claimed in claim 1 wherein the flexible reflective sheet comprises a reflective film.

6. A lighting device as claimed in claim 1 wherein the first plurality of solid state light emitting elements comprises an arrangement of light emitting diodes aligned in a strip, the strip extending along the length of the tubular body.

7. A lighting device as claimed in claim 6 wherein the light emitting elements are carried by a flexible PCB secured to a surface of the first carrier.

8. A lighting device as claimed in claim 1 further comprising: an end cap for holding the assembled light emitting elements, carrier and reflector together.

9. A lighting device as claimed in claim 1 further comprising; a second plurality of solid state light emitting elements arranged on a second surface of a second carrier inside said tubular body; wherein the first surface and second surface are covered by opposing ends of the flexible reflective sheet.

10. A lighting device as claimed in claim 9 wherein the first and second carriers are arranged in the tubular body on opposite sides of the light outlet portion.

11. A luminaire into which is electrically connected a lighting device in accordance with claim 1.

12. A method for the manufacture of a lighting device comprising:

electrically connecting a first plurality of solid state light emitting elements to a first flexible printed circuit board;

providing a length of a first metal sheet bent along a longitudinal axis;

securing the first flexible printed circuit board to a first surface of the metal sheet;

forming an assembly by adhering a tubularly-shaped flexible reflective sheet to at least said first surface whilst leaving the first plurality of solid state light emitting elements exposed;

arranging the assembly in a tubular body shaped substantially-similar to the tubularly-shaped flexible reflective sheet such that the flexible reflective sheet covers a first part of an inner surface of said tubular body whilst leaving exposed a second part of said inner surface, said second part forming part of a light transmissive light outlet portion, and wherein the first part is dimensioned such that direct visibility of the light emitting surface of the light emitting elements is obscured if viewed through the light outlet portion from a location external to the tubular body; and aligning the tubularly-shaped flexible reflective sheet against the inner surface of the tubular body.

13. A method as claimed in claim 12 wherein the multiple light emitting elements comprise LEDs which are welded to the PCB.

14. A method as claimed in claim 12 further comprising:

electrically connecting a second plurality of solid state light emitting elements to a second flexible printed circuit board;

providing a length of a second metal sheet bent along a longitudinal axis; securing the second flexible printed circuit board to a second surface of the metal sheet;

and wherein the step of forming said assembly further comprises adhering the flexible reflective sheet to at least said second surface whilst leaving the second plurality of solid state light emitting elements exposed, wherein said first surface and second surface are covered by opposite ends of the flexible reflective sheet.

15. A method as claimed in claim 12, wherein the step of forming said assembly further comprises:

providing a pair of oppositely magnetised metal strips for securing against a free end of the flexible reflective sheet, which strips are held in position over the free end of the flexible reflective sheet on opposing surfaces of the flexible reflective sheet, the first surface of the metal sheet being covered by an opposite end of the flexible reflective sheet prior to arranging the assembly in the tubular body.

* * * * *